US005683056A

United States Patent [19]

Gravitt

[11] Patent Number: 5,683,056

[45] Date of Patent: Nov. 4, 1997

[54] YARN PACKAGE HOLDER

[76] Inventor: Harry E. Gravitt, 4849 S. Dixie Rd., Resaca, Ga. 30735

[21] Appl. No.: 774,095

[22] Filed: Dec. 24, 1996

Related U.S. Application Data

[63] Continuation-in-part of Ser. No. 625,137, Apr. 1, 1996, abandoned.

[51] Int. Cl.[6] ..... B65H 75/24; B65H 49/02

[52] U.S. Cl. ..... 242/571.5; 242/130; 242/131

[58] Field of Search ..... 242/571, 571.3, 242/571.4, 571.5, 131, 131.1, 130, 130.4, 575, 593, 594.6, 597.1

[56] References Cited

U.S. PATENT DOCUMENTS

| | | | |
|---|---|---|---|
| 1,340,978 | 5/1920 | Parks | 242/130 |
| 3,716,203 | 2/1973 | Beasley | 242/131 |
| 4,760,977 | 8/1988 | Wright, Jr. et al. | 242/131 X |
| 4,824,042 | 4/1989 | Whitaker et al. | 242/131 X |
| 4,880,184 | 11/1989 | Crow | 242/131 X |
| 5,125,591 | 6/1992 | Byars | 242/131 X |
| 5,383,621 | 1/1995 | Alexander | 242/131 X |

FOREIGN PATENT DOCUMENTS

| | | | |
|---|---|---|---|
| 1222608 | 1/1960 | France | 242/130 |

*Primary Examiner*—Michael Mansen
*Attorney, Agent, or Firm*—Alan Ruderman

[57] ABSTRACT

A package holder for mounting a yarn package to a bracket in a creel includes an elongated body member having front and rear ends, a mounting member for attaching the holder to a bracket in the creel intermediate the front and rear ends, and a package securing arm pivotally mounted at a first end intermediate the mounting member and the rear end of the body member. The arm includes a second end and has barbs in an intermediate portion between the first and second ends. The body member includes a notch adjacent the rear end. The mounting member is mounted on the bracket of a creel and the yarn package is positioned so that the body member is received within the core of the package and as the package is pushed rearwardly it engages the arm until the end of the core engages the notch and is stopped. The barbs on the arm grip the interior of the core and acting with gravitational force securely holds the package on the holder. When the package is empty of yarn, a creel attendant lifts the second end of the arm to release the empty core.

11 Claims, 2 Drawing Sheets

YARN PACKAGE HOLDER

REFERENCE TO RELATED APPLICATIONS

This application is a continuation-in-part of U.S. application Ser. No. 08/625,137 filed Apr. 1, 1996 now abandoned.

BACKGROUND OF THE INVENTION

This invention relates to a yarn package holder used on a creel in conjunction with textile machinery such as tufting machines, and more particularly to such a holder which may readily receive a yarn package and release the empty tube such as a yarn cone.

In the tufting art, for example, yarn is generally fed to the machine from a creel, although it may be fed from a warper. A creel is a frame having an array of vertical and horizontal support members and including a multiplicity of yarn package holders. The packages may be either in a conical or cylindrical tubular form about which yarn is wound. Since in most cases, the yarn is wound upon a cone, the term yarn cone when will hereinafter be understood to include a cylindrical tubular form about which the yarn is wound. In a creel, there are a multiplicity of yarn cone holders provided in horizontally and vertically disposed pairs, one holder of the pair mounting the active yarn package and the other mounting a reserve or magazine package used after the active package is empty. A warper is a machine having a large spool, known in the art as a beam, on which yarn is wound and which subsequently supplies yarn to a tufting machine.

The yarn package holders are mounted on a bracket comprising a metal rod bent into a U-shaped form having a central portion and a pair of outstanding legs. The shape is similar to a bicycle handlebar and the horns of a bull and may be known in the art as a "bull horn". Reference may be had to Beasley U.S. Pat. No. 3,716,203 illustrating a creel having such brackets. The yarn package holder in the prior art comprises a wire form having a free end for receiving the yarn package, the wire form creating a resilient spring-like member. For example, a package holder of this type is illustrated in Whitaker et al U.S. Pat. No. 4,824,042, such a holder being secured to each leg of the "bull horn." The wire form, as aforesaid, is configured so as to be resilient and a yarn cone may be pushed over the ends of the wire form for receipt thereon and pulled off after the cone has been emptied and the reserve or magazine cone has been placed in active service.

One of the problems with the use of the spring-like resilient wire form is that a substantial amount of pressure is required to force the yarn package, either cone or cylinder, fully onto the form and to remove an empty package tube off the form. A single deck creel may be in the order of 7½ to 8 feet in height having approximately 8 holders spaced vertically apart. With the prior art spring type holder, the packages to be placed on the uppermost and lowermost package holders are difficult to mount since substantial pressure is required and the creel attendant must stretch to the uppermost holder and bend to the lowermost holder. Removing the empty tubes may be even more difficult since spring force is resisting removal. Because of this, creel attendants fatigue and tire rapidly.

Aside from the creel package holders illustrated in the aforesaid Beasley and Whitaker et al patents, other package holders are illustrated in U.S. Pat. No. 4,880,184 (Crow); U.S. Pat. No. 5,125,591 (Byars) and U.S. Pat. No. 5,383,621 (Alexander). Additionally, other thread or yarn holding devices are illustrated in U.S. Pat. No. 1,340,978 (Parks) and French Patent No. 1,222,608. All of these patents were brought to light by the U.S. Patent & Trademark Office in the aforesaid copending patent application Ser. No. 08/625,137 filed by the applicant herein.

SUMMARY OF THE INVENTION

Consequently, it is a primary object of the present invention to provide a yarn package holder that permits a yarn package such as a yarn cone or cylinder to be mounted readily on a creel or the like and permits easy release of the yarn tube after the package is empty.

It is another object of the present invention to provide a yarn package holder that may be used with tubular forms of substantially any shape about which yarn is wound so that the package may be readily mounted on a creel and an empty tube may be readily removed.

It is a further object of the present invention to provide a yarn package holder that secures a yarn package in operative position on a creel without the use of spring forces so that a full package may be readily mounted and an empty package readily removed from the holder and thus the creel.

To this end, the package holder of the present invention comprises an elongated body member to which a mounting member is secured intermediate the front and rear ends of the body member for attaching the holder to a "bull horn" bracket of a creel, and an arm pivotally carried by the body member intermediate the mounting member and the rear end of the body member so that the arm may pivot relative to the front and rear ends of the body member, the arm having one or more barbs on a surface facing forwardly when the arm is in a neutral position for engaging and gripping the interior of the tubular form of a yarn package when the yarn package is pushed onto the front end and toward the rear end of the body member. Adjacent the rear end, the body member has a step which acts as a stop to limit the rearward extent of movement of the yarn package. The yarn package may thus be readily mounted on the holder and held securely in place by the frictional force created by the weight of the arm with the barbs gripping the interior of the tube. When an empty tube is to be removed from the holder, the arm is manually pushed up toward the rear of the body member to release the barbs so that the tube may be readily removed.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
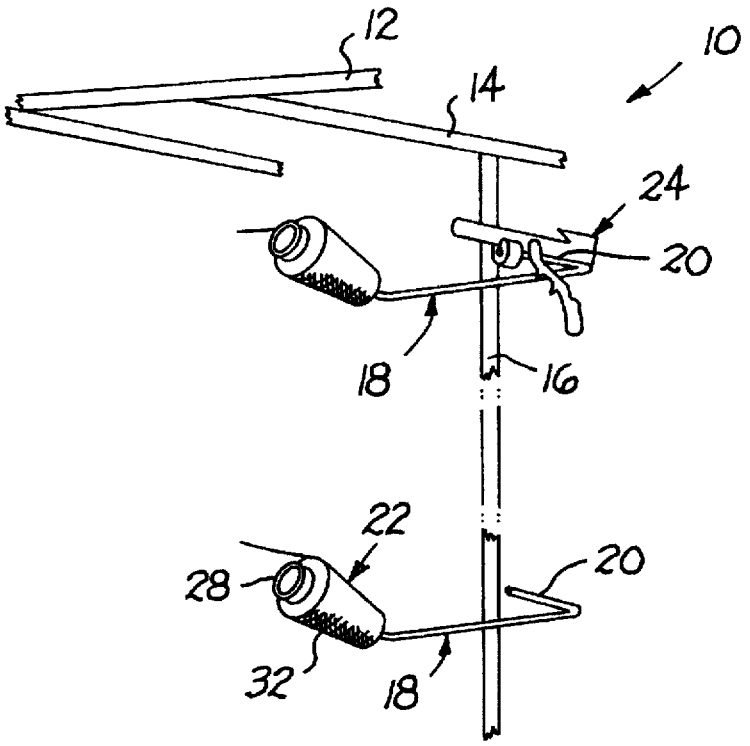
FIG. 1 is a fragmentary perspective view of a portion of a creel illustrating a yarn package holder constructed in accordance with the principles of the present invention mounted thereon.

Referring to the drawings, FIG. 1 illustrates a portion of the creel 10 which comprises a substantially rectangular framework including horizontal support members 12, 14 and vertical posts 16. Secured as by welding to the vertical posts at vertically spaced apart locations are brackets 18 comprising metal rods of a substantially cylindrical cross section bent into a U-shaped configuration sometimes referred to a "bull horn," the central portion of which is secured to the vertical members with the legs 20 (only one for each bull horn being illustrated) outstanding away from the post 16 in the direction toward where a creeler or creel attendant (not illustrated) is generally located. The creeler insures that packages 22 of yarn are mounted on a yarn package holder which is secured to the legs 20 of the U-shaped "bull horn" bracket. In accordance with the present invention, the upper most bull horn illustrates a yarn package holder 24 constructed in accordance with the present invention.

Figure 2:
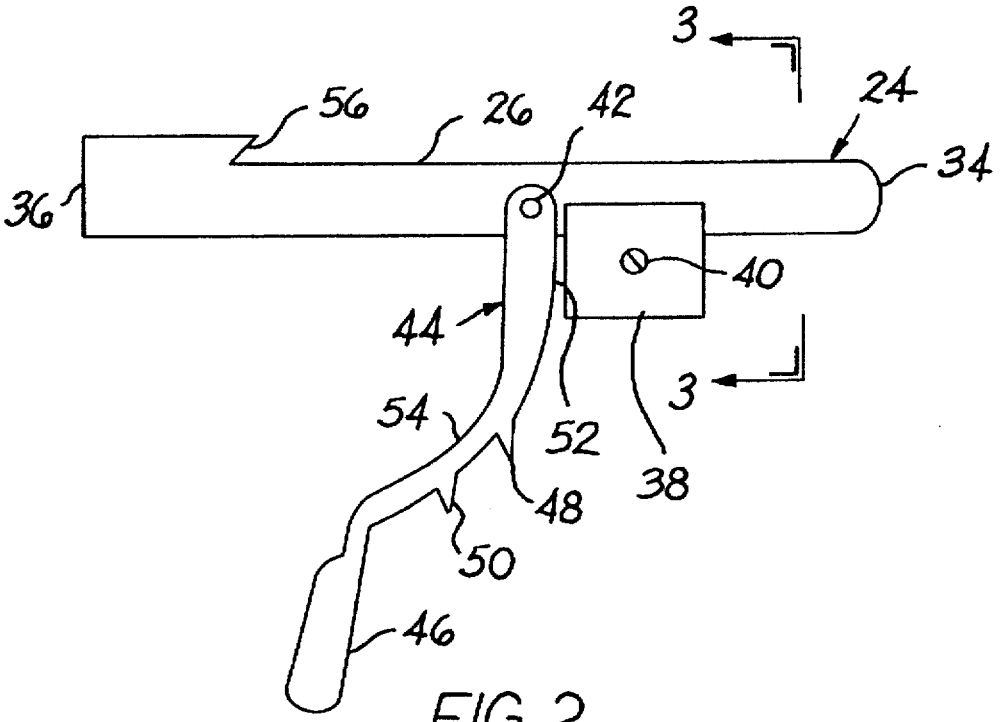
FIG. 2 is a side elevational view of the yarn package holder of the present invention.
Figure 3:
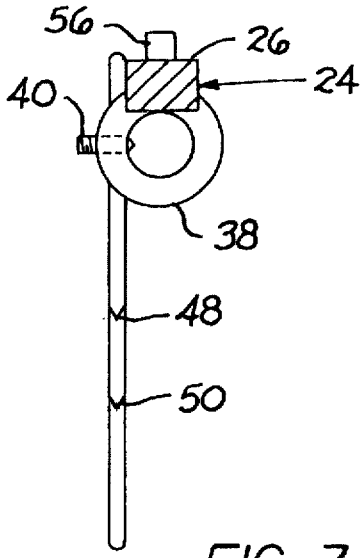
FIG. 3 is a front cross sectional view of the holder taken along line 3—3 of FIG. 2.
Figure 4:
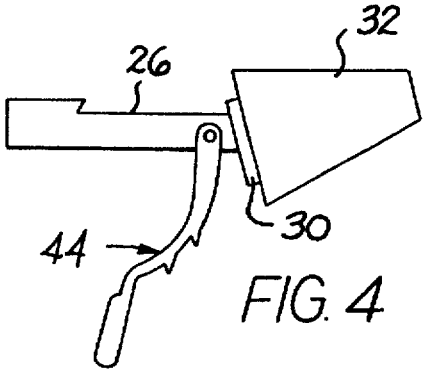
FIGS. 4 through 6 are diagrammatic views which illustrate steps in mounting a yarn cone on the holder.
Figure 5:
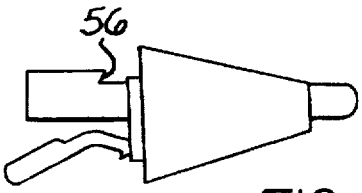
Figure 6:
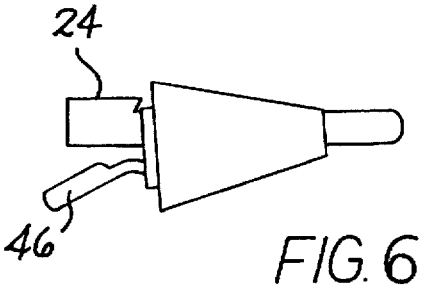

As best illustrated in FIGS. 2 and 3, the yarn package holder 24 comprises an elongated body member 26 of any convenient shape such as one with a substantially rectangular cross section as illustrated, the dimensions of the member 26 being such that it is longer than the tubular core of the packages and will be received readily within the hollow of the yarn package tube, either a cylindrical shaped tube 28 as illustrated in FIG. 1 or conical shaped tubes 30 as illustrated in FIGS. 4–6, the tubes, of course, having yarn 32 wound thereon. Secured, as by welding or the like, to the body member 26 intermediate its front end 34 and its rear end 36 is a mounting member 38 having a substantial annular configuration as best illustrated in FIG. 3 for receipt about a leg 20 of the bull horn bracket 18, a set screw 40 or the like being threaded through the annulus to secure the mounting member 38 and thus the package holder 24 to the leg 20 as illustrated in FIG. 1. The combined cross sectional configuration of the body member 26 and the mounting member 38 is such that both are receivable within the yarn package tubes 28, 30 as hereinafter described.

Pivotally mounted to the body member 26 by means of a shoulder screw 42 or the like intermediate the rear end 36 and the mounting member 38 is a package securing arm 44. The arm 44 includes an operator engagable free end portion 46 and at least one and preferably two barbs 48, 50 intermediate the free end portion 46 and a forward portion 52, the shoulder screw 42 being received adjacent the end of the forward portion. Preferably, as illustrated, the free end portion 46 is offset from the forward portion 52 so that the barbs 48, 50 may engage the interior of either cylindrical or conical tubes 28, 30 while the free end portion 46 protrudes out the end of the tube as illustrated in FIG. 6 for reasons hereinafter made clear. The offset in the intermediate portion 54 may be slightly curvilinear if this is found to be more compatible to the interior configuration of a tubular cone 30. Also if the rear barb 50 is made slightly longer than the barb 48, both barbs may engage the interior wall of a conical tube 30 if desirable.

At the rear of the body member 24 on the upper surface there is a notch or step 56 which provides a stop for a yarn package tube to position the yarn package properly on the holder 24. Preferably, the notch or step 56 is an inclined step extending upwardly and forwardly from the upper surface of the body member 26. As illustrated, the notch or step 56 is in a portion of the body member which may be narrower than the remainder of the body member as illustrated in FIG. 3, but of course, the portion in which the step is formed may be of the same width as the remainder of the body portion.

In use, the mounting member 38 of the holder 24 is first secured to a leg 20 of a bull horn bracket 18 with the arm 44 toward the bottom and the step 56 at the top, i.e., the position illustrated in FIG. 3. Gravity thus acts to force the arm to pivot downwardly to the position illustrated in FIG. 2. When a yarn package is to be placed on the holder, it is merely positioned over the front end 34 and moved rearwardly as illustrated in FIG. 4 until it engages the arm 44 as illustrated in FIG. 5. The barbs thereafter engage the interior of the tube of the yarn package as the package is moved rearwardly until the tube engages and is stopped by the notch 56 as illustrated in FIG. 6. The weight of the arm causes the barbs to securely grip the interior of the tube as the yarn is supplied to the textile machine from the creel in which it is mounted. When the yarn package is empty of yarn, the creel operator merely lifts up on the free end portion 46 to release the barb or barbs on the arm 44 from the interior of the tube and the tube is thereafter readily removed with very little effort. Thus, very little effort is required to place a yarn package in proper position on the creel and to remove an empty tube. As aforesaid, this is a substantial improvement over the effort required by prior art yarn package holders.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims Having thus set forth the nature of the invention, what is claimed herein is:

1. A yarn package holder for mounting a yarn package having a hollow tubular core about which yarn is wound on a bracket in a creel or the like, said package holder comprising an elongated body member having a front end and a rear end, a mounting member intermediate the front and rear ends of said body member for attaching said package holder to said bracket with said front end available for being received within the tubular core of a yarn package and with said rear end remote therefrom, said body member and said mounting member having a combined cross section receivable within said core, a package securing arm having first and second ends, journal means for pivotally connecting said arm adjacent said first end to said body member intermediate said mounting member and said rear end, said arm having at least one barb thereon in a portion of said arm intermediate said first and second ends extending from said arm in a direction for engaging and gripping the interior of a tubular core of a yarn package within which said front end has been received as said package is pushed over said body member toward said rear end, and stop means for limiting the movement of said package over said body member toward said rear end while permitting said second end of said arm to extend out the tubular core of said package available for grasping by a creel attendant.

2. A yarn package holder as recited in claim 1, wherein said second end of said arm is offset from said first end.

3. A yarn package holder as recited in claim 2, wherein said stop means comprises a step in said body member intermediate said journal means and said rear end.

4. A yarn package holder as recited in claim 3, wherein said bracket includes a substantially cylindrical leg having a free end, said mounting member comprising an annular member for receiving said free end of said leg, and securing means for securely fastening said annular member about said leg.

5. A yarn package holder as recited in claim 2, wherein said bracket includes a substantially cylindrical leg having a free end, said mounting member comprising an annular member for receiving said free end of said leg, and securing means for securely fastening said annular member about said leg.

6. A yarn package holder as recited in claim 2, wherein said portion intermediate said first and second ends has a curvilinear configuration.

7. A yarn package holder as recited in claim 6, wherein said stop means comprises a step in said body member intermediate said journal means and said rear end.

8. A yarn package holder as recited in claim 7, wherein said bracket includes a substantially cylindrical leg having a free end, said mounting member comprising an annular member for receiving said free end of said leg, and securing means for securely fastening said annular member about said leg.

9. A yarn package holder as recited in claim 1, wherein said stop means comprises a step in said body member intermediate said journal means and said rear end.

10. A yarn package holder as recited in claim 1, wherein said bracket includes a substantially cylindrical leg having a free end, said mounting member comprising an annular member for receiving said free end of said leg, and securing means for securely fastening said annular member about said leg.

11. A yarn package holder as recited in claim 4, wherein said stop means comprises a step in said body member intermediate said journal means and said rear end.

* * * * *